US006293829B1

(12) United States Patent
Qiao et al.

(10) Patent No.: US 6,293,829 B1
(45) Date of Patent: Sep. 25, 2001

(54) ELECTRICAL CONNECTOR WITH WIRE MANAGEMENT SYSTEM

(75) Inventors: Huili Qiao; Gary S. Manchester, both of Naperville; Richard A. Nelson, Geneva; Galen Fromm, North Aurora, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/648,698

(22) Filed: Aug. 25, 2000

(51) Int. Cl.[7] ..... H01R 9/22
(52) U.S. Cl. ..... 439/719; 439/404; 439/942
(58) Field of Search ..... 439/404, 405, 439/406, 407, 714, 717, 719, 942, 470

(56) References Cited

U.S. PATENT DOCUMENTS

| | | | | |
|---|---|---|---|---|
| 4,655,515 | | 4/1987 | Hamsher, Jr. et al. | 439/108 |
| 5,052,104 | | 10/1991 | Tran | 29/861 |
| 5,110,306 | | 5/1992 | Buck et al. | 439/497 |
| 5,118,306 | | 6/1992 | Bixler et al. | 439/405 |
| 5,267,874 | | 12/1993 | Koegel et al. | 439/497 |
| 5,288,250 | * | 2/1994 | Sumida | 439/701 |
| 5,520,550 | * | 5/1996 | Okabe | 439/404 |
| 5,603,634 | | 2/1997 | Ichikawa et al. | 439/404 |
| 5,766,033 | * | 6/1998 | Davis | 439/405 |
| 5,855,493 | | 1/1999 | Shelly | 439/465 |
| 5,944,552 | | 8/1999 | Hanami | 439/465 |
| 5,953,815 | | 9/1999 | Kaminski et al. | 29/860 |
| 6,039,611 | | 3/2000 | Yang | 439/701 |
| 6,106,326 | * | 8/2000 | Schramme | 439/460 |

* cited by examiner

*Primary Examiner*—Tulsidas Patel
(74) *Attorney, Agent, or Firm*—Robert J. Zeitler

(57) ABSTRACT

An electrical connector includes an elongated dielectric housing having a central body portion with a front face, a rear face and at least three rows of terminal-receiving passages extending therebetween and including a top row, a middle row and a bottom row. A plurality of terminals are received in the passages and include top terminals received in at least some of the passages in the top row, middle terminals received in at least some of the passages in the middle row and bottom terminals received in at least some of the passages in the bottom row. All of the terminals have tail portions projecting rearwardly from the body portion beyond the rear face thereof. A pair of juxtaposed wire guide members include a top wire guide member having a top surface with wire-receiving channels for aligning a plurality of electrical wires with the tail portions of the top row of terminals. A bottom wire guide member has a bottom surface with wire-receiving channels for aligning a plurality of electrical wires with the tail portions of the bottom row of terminals. Guide channels are provided between the wire guide members for receiving a plurality of electrical wires aligned with the tail portions of the middle row of terminals.

25 Claims, 3 Drawing Sheets

ELECTRICAL CONNECTOR WITH WIRE MANAGEMENT SYSTEM

FIELD OF THE INVENTION

This invention generally relates to the art of electrical connectors and, particularly, to a connector having a wire management means for facilitating terminating the conductors of a plurality of electrical wires to the terminating portions of the connector terminals.

BACKGROUND OF THE INVENTION

A known type of input/output (I/O) electrical connector includes an elongated dielectric housing having a front mating face and a rear face with a plurality of terminal-receiving passages extending therebetween. The faces extend longitudinally between opposite ends of the elongated housing. A plurality of terminals are received in the passages. Each terminal includes a forwardly projecting contact portion and a tail portion projecting rearwardly from the housing beyond the rear face thereof. The tail portions typically are inserted into holes in a printed circuit board, surface mounted to circuit traces on a circuit board or connected directly to the center conductors of discrete electrical wires.

With the ever-increasing miniaturization of the electronics in various industries, such as in the computer and telecommunications industries, along with the accompanying miniaturization of electrical connectors, considerable problems have been encountered in terminating miniature terminals, particularly the terminal tails. This is particularly true when the tail portions of the terminals are terminated to "loose" or freely movable electrical wires (versus more stationary circuit traces of a generally rigid circuit board). This problem of terminating the tiny terminal tails to the conductors of discrete electrical wires is magnified or compounded when the terminals are mounted in the connector housing in a plurality of closely spaced rows which is typical in many known I/O electrical connectors. The present invention is directed to solving these problems by providing a unique wire management system in such an electrical connector, including the connector, itself, as well as a method of assembling or terminating the connector.

SUMMARY OF THE INVENTION

An object, therefore, of the invention is to provide a new and improved electrical connector of the character described, including a wire management means for facilitating termination of the tail portions of a plurality of terminals to the conductors of a plurality of electrical wires, particularly when the terminals are mounted in rows in the connector housing.

Another object of the invention is to provide a new and improved method of terminating a plurality of electrical wires to a plurality of terminals of an electrical connector as described.

Another object of the invention is to provide a wire management system wherein the individual wires are kept spaced from each other and prevented from getting tangled with the other wires to improve the electrical performance and integrity of the connector/cable system.

In the exemplary embodiment of the invention, the connector includes an elongated dielectric housing having a central body portion with a front face, a rear face and at least three rows of terminal-receiving passages extending therebetween and including a top row, a middle row and a bottom row. A plurality of terminals are received in the passages and include top terminals received in at least some of the passages in the top row, middle terminals received in at least some of the passages in the middle row and bottom terminals received in at least some of the passages in the bottom row. All of the terminals have forward contact portions and tail portions projecting rearwardly from the body portion beyond the rear face thereof. In the embodiment disclosed herein, the tail portions of the middle terminals are longer than the tail portions of the top terminals.

The invention contemplates a wire management system which includes a pair of juxtaposed wire guide members including a top wire guide member having a top surface with wire-receiving channels for aligning a plurality of electrical wires with the tail portions of the top row of terminals. A bottom wire guide member has a bottom surface with wire-receiving channels for aligning a plurality of electrical wires with the tail portions of the bottom row of terminals. Guide means are provided between the wire guide members for receiving a plurality of electrical wires aligned with the tail portions of the middle row of terminals.

According to one aspect of the invention, the wire guide members are hermaphroditic. The two wires guide members include opposing, generally semi-cylindrical wire-receiving channels in the inside surfaces thereof defining the guide means for receiving the electrical wires aligned with the tail portions of the middle row of terminals.

According to another aspect of the invention, the rear face of the housing includes a receptacle for receiving forward ends of the wire guide members. The guide means between the wire guide members are sized to allow the wire guide members to be juxtaposed about the electrical wires aligned with the tail portions of the middle row of terminals and slid forward into the receptacle.

A further feature of the invention includes attachment means between the wire guide members to hold the members about the electrical wires aligned with the middle row of terminals. As disclosed herein, the attachment means include at least one post on at least one of the wire guide members press-fit into a hole in the other wire guide member.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

Generally.

Specifically, FIG. 1 shows the conductors of a plurality of electrical wires terminated to the tail portions of the middle row of terminals of the connector;

FIG. 2 shows the hermaphroditic wire guide members being positioned about the electrical wires terminated to the tail portions of the middle row of terminals;

FIG. 3 is a view similar to that of FIG. 2, but with the wire guide members fully closed about the electrical wires;

FIG. 4 is a view similar to that of FIG. 3, but with the wire guide members slid forward into the receptacle at the rear of the connector;

Detailed Description of the Preferred Embodiments

Figure 1:
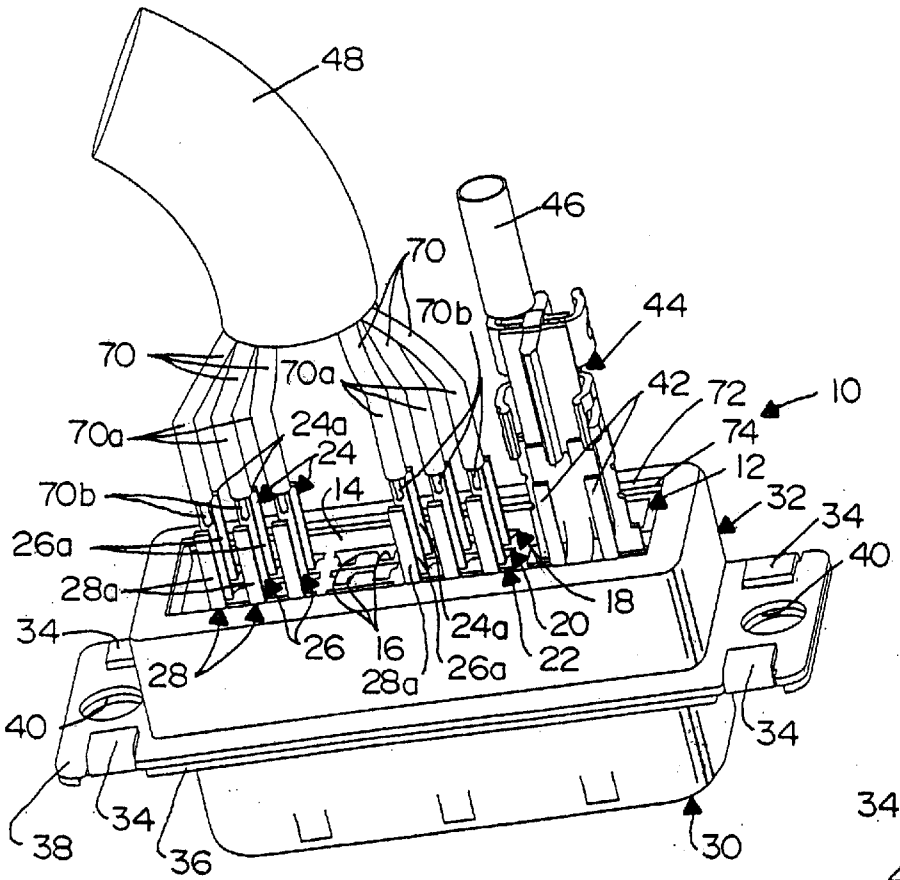

Referring to the drawings in greater detail, and first to FIG. 1, the wire management system of the invention is incorporated in an electrical connector, generally designated 10, which includes an elongated dielectric housing, generally designated 12, having a central body portion which defines a front face (not visible in the drawing), a rear face 14 and at least three rows of terminal-receiving passages 16 extending therebetween. The three rows of passages include a top row, generally designated 18, a middle row, generally designated 20, and a bottom row, generally designated 22.

At this point, it should be understood that the use of the terms "top", "bottom" and "middle" herein and in the claims hereof is not in any way intended to be limiting. These terms are used herein to provide a clear and concise understanding of the invention. Electrical connector 10 is omni-directional in use and such terms are basically in reference to the depiction or orientation in some of the drawings to best understand the invention.

With that understanding, a plurality of terminals are received in passages 16 and include top terminals, generally designated 24, received in at least some of the passages in top row 18 thereof; middle terminals, generally designated 26, received in at least some of the passages in middle row 20 thereof; and bottom terminals, generally designated 28, received in at least some of the passages in bottom row 22 thereof. All of the terminals have forward contact portions extending into housing 12 but which are not visible in the drawings. Top terminals 24 have tail portions 24*a*, middle terminals 26 have tail portions 26*a* and bottom terminals 28 have tail portions 28*a*, with all of the tail portions projecting rearwardly from the housing beyond rear face 14 thereof In the embodiment shown, the middle tail portions 26*a* are longer than top and bottom tail portions 24*a* and 28*a*, respectively. However, the tail portions 24*a*, 26*a* and 28*a* may all be the same length, different lengths or any combination of lengths.

Connector 10 is an input/output (I/O) electrical device and wherein inner dielectric housing 12 is substantially surrounded by a front shield, generally designated 30, and a back shield, generally designated 32. Each of the shields is a one-piece structure stamped and formed of conductive sheet metal material. Front shield 30 has four rearwardly formed tabs 34 which are bent from a base plate 36 of the front shield over a base plate 38 of the rear shield to secure the front and rear shields about connector housing 12. Holes 40 are formed in base plates 36 and 38 for mounting the connector to an appropriate structure.

In I/O connector 10, terminals 24–28 are data transmission terminals. Although not germane to the invention, the connector also includes a plurality of high speed signal terminals having tail portions 42 terminated by an independent wire management device, generally designated 44, to the conductors (not shown) of a high speed signal cable 46. As will be described in greater detail hereinafter, tail portions 24*a*–28*a* of terminals 24–28, respectively, are terminated to the conductors of a plurality of discrete electrical wires from an electrical cable 48.

Figure 2:
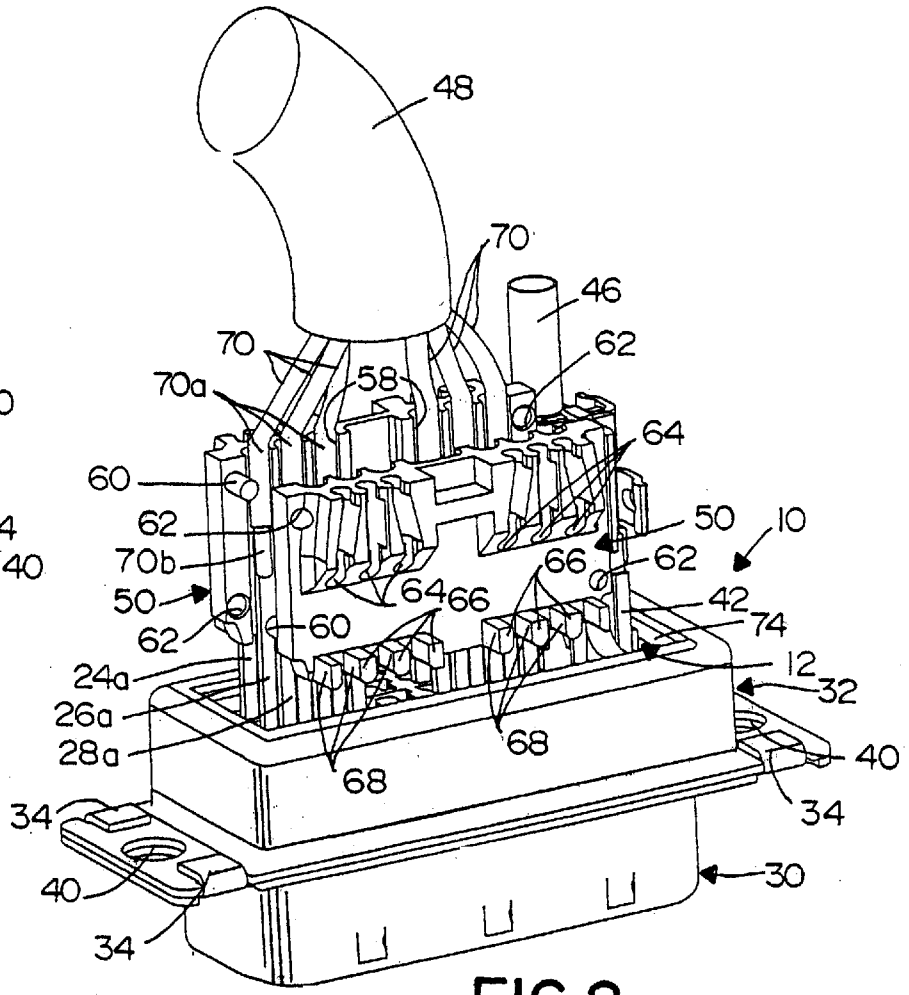
FIGS. 1–4 are sequential views showing the termination method using the wire management system of the invention.
Figure 4:
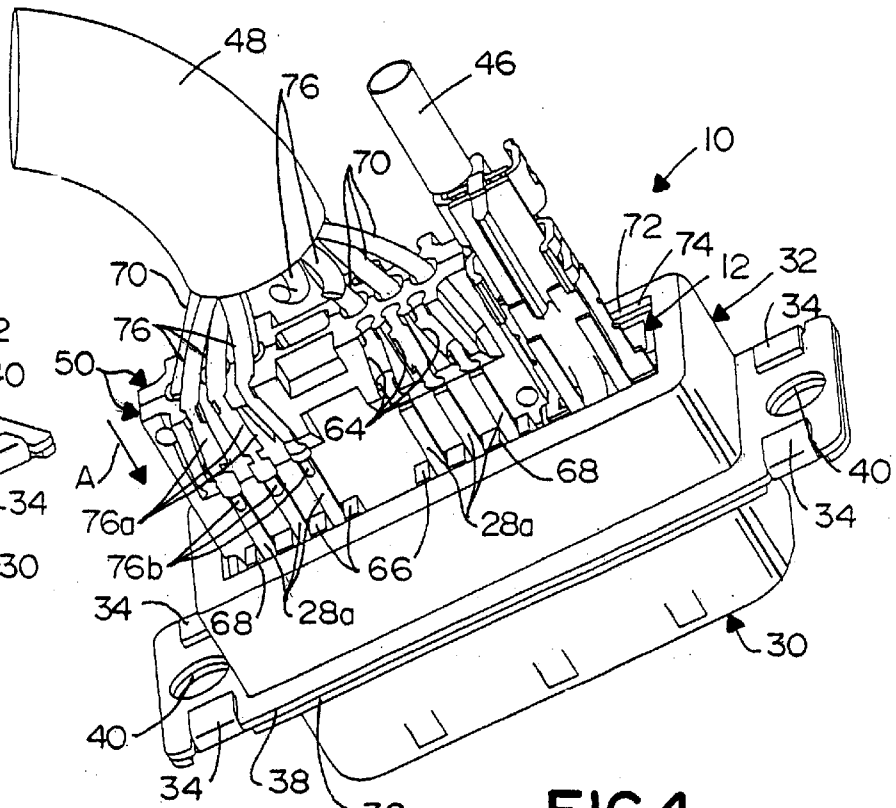
Figure 3:
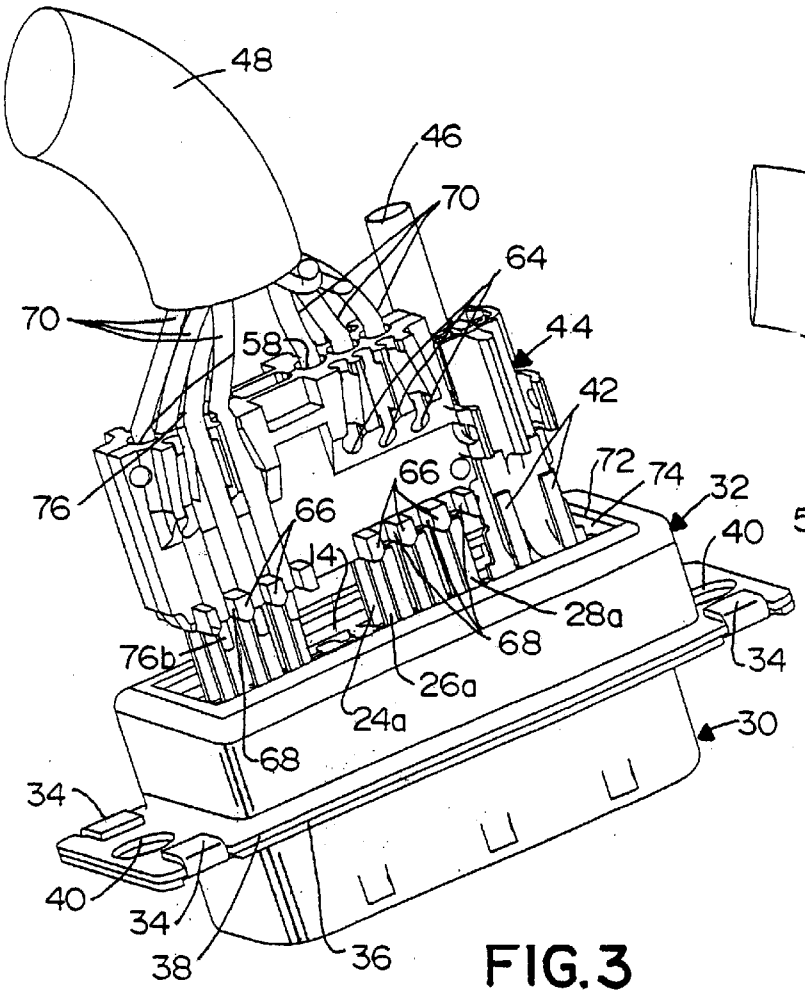

The wire management system of the invention contemplates the use of a pair of wire guide members, generally designated 50 and shown in conjunction with connector 10 in FIGS. 2–4. The wire guide members are shown in FIG. 5 isolated from the connector and first will be described in detail before going into their use and the termination method of the invention in relation to FIGS. 2–4.

Figure 5:
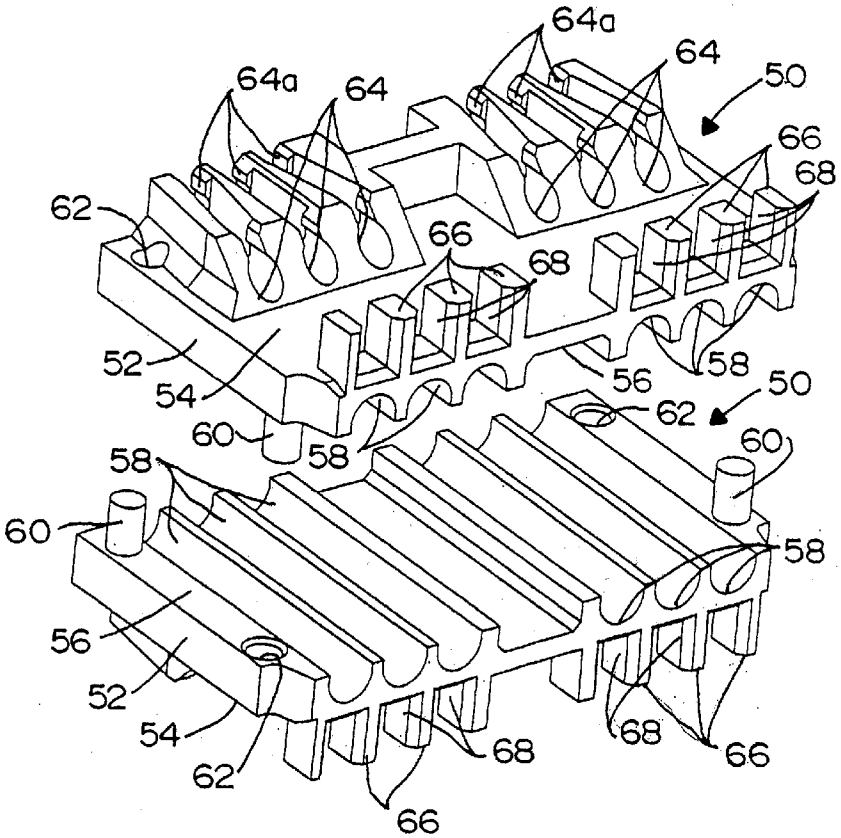
FIG. 5 is a perspective view of the pair of wire guide members isolated from the connector.

More particularly, referring specifically to FIG. 5, wire guide members 50 of the embodiment disclosed herein are hermaphroditic, i.e., they are identical in construction, although the invention is no limited to hermaphroditic wire guide members. Each wire guide member 50 includes an elongated, generally rectangular plate-like body 52 having an outside surface 54 and an inside surface 56. In use, the pair of wire guide members are juxtaposed so that inside surfaces 56 face each other. When the wire guide members are juxtaposed together as seen in FIGS. 3 and 4, a plurality of semi-cylindrical wire-receiving channels 58 in the inside surfaces of the members combine to form cylindrical wire-receiving channels. Each wire guide member includes a pair of inwardly projecting posts 60 which are press-fit into a pair of holes 62 in the other wire guide member to hold the members juxtaposed about certain electrical wires of cable 48, as described hereinafter.

Still referring to FIG. 5, each wire guide member 50 includes a plurality of wire-receiving channels 64 which are raised above outside surface 54. Channels 64 have restricted mouths 64*a* past which conductors of the electrical wires of cable 48 can be snapped into the channels, and wider middle portions 64*b* to aid in molding the channels of the wire guide members. Preferably, the wire guide members are molded of dielectric material such as plastic or the like. A plurality of post-like partitions 66 project from outside surface 54 of each wire guide member and define passages 68 therebetween for receiving tail portions 24*a* and 28*a* of terminals 24 and 28, respectively, as will be seen hereinafter. Passages 68 for the tail portions are aligned with channels 64 for receiving the electrical conductors. Channels 64 are at different angles to compensate for the different angles the electrical wires emanate from cable 48. Channels 64 are raised above surface 54 to accommodate the insulation about the conductors of the electrical wires.

Referring back to FIG. 1, electrical cable 48 includes a plurality of discrete electrical wires having conductors surrounded by insulation. All of the electrical wires from cable 48 are not shown in all of the drawings to avoid unnecessarily cluttering the illustrations. Suffice it to say, FIG. 1 shows a plurality of electrical wires 70 having the insulation 70*a* thereof removed to expose lengths of the conductors 70*b* thereof. The first step in terminating the electrical wires of cable 48 is to connect conductors 70*b* of electrical wires 70 to tail portions 26*a* of the middle row 20 of terminals 26. This is shown in FIG. 1 and can be performed by soldering the conductors to the tail portions. Again, the remaining electrical wires of cable 48 are not shown in FIG. 1 in order to avoid cluttering the drawings.

FIGS. 2 and 3 show wire guide members 50 being brought together about conductors 70*b* of electrical wires 70 that have been connected to tail portions 26*a* of middle row 20 of terminals 26 until the wire guide members are juxtaposed about the conductors. When in the juxtaposed position of the wire guide members as shown in FIG. 3, the conductors of the electrical wires and the tail portions of the middle row of terminals are disposed within cylindrical passages defined by semi-cylindrical wire-receiving channels 58 (FIG. 5) in the inside surfaces of the wire guide members. It should be pointed out that the cross-dimensions of these passages are larger than the conductors or the tail portions so that the wire guide members can move longitudinally thereof as described below. Finally, in the juxtaposed position of the wire guide members as shown in FIG. 3, attachment posts 60 (FIG. 5) have been press-fit into holes 62 of the opposing wire guide members.

The next step in the method of the invention is to slide the juxtaposed wire guide members from the position shown in FIG. 3 in the direction of arrow "A" (FIG. 4) to the position shown in FIG. 4. Rear shell 32 has an opening 72 aligned with a receptacle 74 in the rear face of connector housing 12 so that the front ends of the wire guide members can be slid into the receptacle to the position shown in FIG. 4. When the wire guide members are slid forward, it can be seen that tail portions 28*a* of the bottom row of terminals 28 have moved into passages 68 between partitions 66 on the outside of the bottom-most wire guide member. Although not visible in FIG. 4, and with the wire guide members are hermaphroditic, tail portions 24*a* of the top row of terminals 24 also slide into the passages between the partitions of the other wire guide members. This aligns the tail portions with wire receiving channels 64 in the outsides of the wire guide members.

The final step in the method of the invention is shown in FIG. 4, wherein conductors 76*b* of a plurality of electrical wires 76 are connected, as by soldering, to tail portions 28*a* of terminals 28. Again, insulation 76*a* of the electrical wires has been removed to expose the conductors. In order to facilitate the illustration, only three electrical wires have been terminated to the tail portions at the left-hand side of FIG. 4. The right-hand side of the depiction better shows the alignment of tail portions 28*a* within passages 68 between partitions 66, with wire-receiving channels 64 and, thereby, conductors 76*b* of electrical wires 76.

Either simultaneously or sequentially with the termination of the bottom row of terminals, the conductors of additional electrical wires from cable 48 are connected, as by soldering, to tail portions 24*a* of terminals 24 in top row 18 (FIG. 1) on the opposite side of the top wire guide member shown in FIG. 4.

Figure 6:
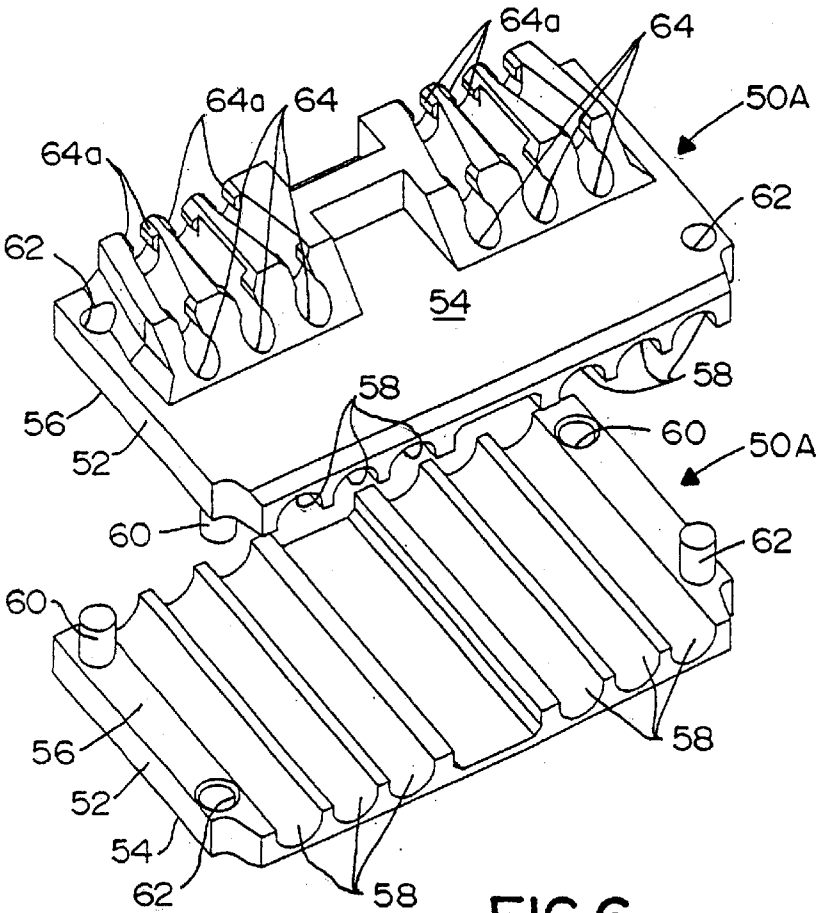
FIG. 6 is a view similar to that of FIG. 5, but of an alternative embodiment of the wire guide members.

FIG. 6 shows an alternate embodiment of a pair of wire guide members, generally designated 50A, which are identical to wire guide members 50 shown in FIG. 5, except that partitions 66 and 68 of wire guide members 50 have been removed. In some applications, this construction of wire guide members 50A is adequate for connecting the conductors of electrical wires to the top and bottom rows of terminal tail portions, simply by positioning the conductors within wire-receiving channels 64 on the outsides of wire guide members 50A.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

an elongated dielectric housing having a central body portion with a front face, a rear face and at least three rows of terminal-receiving passages extending therebetween and including a first row, a second row and a third row;

a plurality of terminals received in the passages and including first terminals received in at least some of the passages in the first row, second terminals received in at least some of the passages in the second row and third terminals received in at least some of the passages in the third row, all of the terminals having forward contact portions and tail portions projecting rearwardly from the body portion beyond the rear face thereof; and a pair of juxtaposed wire guide members including a first wire guide member having a first surface and a second surface, the first surface having wire-receiving channels for aligning a plurality of electrical wires with the tail portions of the first row of terminals, a second wire guide member having a first surface and a second surface, the first surface having wire-receiving channels for aligning a plurality of electrical wires with the tail portions of the third row of terminals, and guide means on the second surfaces of the first and second wire guide members for receiving a plurality of electrical wires aligned with the tail portions of the second row of terminals.

2. The electrical connector of claim 1 wherein the tail portions of the second row of terminals are longer than the tail portions of at least one of the first row and third row of terminals.

3. The electrical connector of claim 1 wherein the second surface of at least one of the wire guide members includes a second surface with wire-receiving channels defining the guide means.

4. The electrical connector of claim 1 wherein the second surface of both of the wire guide members include opposing, generally semi-cylindrical wire-receiving channels defining the guide means.

5. The electrical connector of claim 4 wherein the wire guide members are hermaphroditic.

6. The electrical connector of claim 1, including attachment means between the wire guide members to hold the members about the electrical wires aligned with the second row of terminals.

7. The electrical connector of claim 6 wherein the attachment means include at least one post on at least one of the wire guide members press-fit into a hole in the other wire guide member.

8. The electrical connector of claim 1 wherein the rear face of the housing includes a receptacle for receiving forward ends of the wire guide members.

9. The electrical connector of claim 8 wherein the guide means are sized to allow the wire guide members to be juxtaposed about the electrical wires aligned with the tail portions of the second row of terminals and slid forward into the receptacle.

10. The electrical connector of claim 1 wherein the wire guide members are hermaphroditic.

11. An electrical connector, comprising:

a dielectric housing having at least three rows of terminal-receiving passages including a first row, a second row and a third row;

a plurality of terminals received in the passages and including first terminals received in at least some of the passages in the first row, second terminals received in at least some of the passages in the second row and third terminals received in at least some of the passages in the third row, all of the terminals having tail portions projecting from the housing; and a pair of juxtaposed wire guide members including a top wire guide member having a top surface with top guide means for aligning a plurality of electrical wires with the tail portions of the first row of terminals, a bottom wire guide member having a bottom surface with bottom guide means for aligning a plurality of electrical wires with the tail portions of the third row of terminals, and middle guide means between the wire guide members for receiving a plurality of electrical wires aligned with the tail portions of the second row of terminals.

12. The electrical connector of claim 11 wherein the wire guide members are hermaphroditic and include inside surfaces having opposing, generally semi-cylindrical wire-receiving channels defining the middle guide means.

13. The electrical connector of claim 12, including additional guide means on the top surface and bottom surface of the top wire guide member and bottom guide member, respectively, for receiving the tail portions of the first row of terminals and the third row of terminals, respectively.

14. The electrical connector of claim 11 wherein the housing includes a receptacle about the tail portions of the terminals, and the middle guide means are sized to allow the wire guide members to be juxtaposed about the electrical wires aligned with the tail portions of the second row of terminals and slid forward into the receptacle.

15. A wire management system for use with an electrical connector having a first row, a second row and a third row of terminals, each of the terminals having a tail portion, the wire management system comprising:

a pair of juxtaposed wire guide members including a top wire guide member having a first surface with wire-receiving channels for aligning a plurality of electrical wires with the tail portions of the first row of terminals, a bottom wire guide member having a first surface with wire-receiving channels for aligning a plurality of electrical wires with the tail portions of the third row of terminals, and second surfaces of the wire guide members including opposed wire-receiving surfaces for receiving a plurality of electrical wires aligned with the tail portions of the second row of terminals, wherein at least one of the wire guide members includes a plurality of partitions on the first surface defining passages for receiving the tail portions of the terminals, the partitions and the wire receiving channels being non-contiguous.

16. The wire management system of claim 15 wherein the opposed wire receiving surfaces are generally semi-cylindrical channels.

17. The wire management system of claim 15 wherein the wire guide members are hermaphroditic.

18. The wire management system of claim 15, including attachment means between the wire guide members to hold the members about the electrical wires aligned with the second row of terminals.

19. The wire management system of claim 15 wherein the attachment means include at least one post on at least one of the wire guide members press-fit into a hole in the other wire guide member.

20. The wire management system of claim 15 wherein each of the pair of wire guide members includes a plurality of partitions on the first surface defining passages for receiving the tail portions of the terminals.

21. A method of terminating a plurality of electrical wires to a plurality of terminals of an electrical connector, comprising the steps of:

providing a dielectric housing with at least three rows of terminal-receiving passages including a first row, a second row and a third row;

providing a plurality of terminals in the passages and including first terminals received in at least some of the passages in the first row, second terminals received in at least some of the passages in the second row and third terminals received in at least some of the passages in the third row, all of the terminals having tail portions projecting from the housing;

connecting a plurality of electrical wires to the tail portions of the second row of terminals;

closing a pair of wire guide members, including a top wire guide member having top guide means and a bottom wire guide member having bottom guide means, about the electrical wires connected to the second row of terminals;

sliding the wire guide members forwardly toward a rear face of the housing; and connecting a plurality of electrical wires to the tail portions of the first and third rows of terminals using the top and bottom guide means of the top and bottom wire guide members, respectively.

22. The method of claim 21, including providing the tail portions of the second row of terminals longer than the tail portions of at least one of the first row and third row of terminals.

23. The method of claim 21, including providing the rear face of the housing with a receptacle for receiving forward ends of the wire guide members when the members are slid forwardly against the housing.

24. The method of claim 21 wherein the electrical wires connected to the second row of terminals are captured in opposing channels on the insides of the wire guide members when the members are closed.

25. The method of claim 21 wherein the electrical wires connected to the tail portions of the first and third rows of terminals are aligned with the respective tail portions by channels in the top and bottom wire guide members.

* * * * *